US009431167B2

(12) United States Patent
Guan et al.

(10) Patent No.: US 9,431,167 B2
(45) Date of Patent: Aug. 30, 2016

(54) SINGLE-PHASE ELECTRIC FURNACE TRANSFORMER

(71) Applicant: ALSTOM TECHNOLOGY LIMITED, Baden (CH)

(72) Inventors: Junjun Guan, Shanghai (CN); Serge Tirilly, Massy (FR)

(73) Assignee: Alstom Technology Limited, Baden (CH)

( * ) Notice: Subject to any disclaimer, the term of this patent is extended or adjusted under 35 U.S.C. 154(b) by 0 days.

(21) Appl. No.: 14/437,636

(22) PCT Filed: Sep. 29, 2012

(86) PCT No.: PCT/CN2012/082419
§ 371 (c)(1),
(2) Date: Jun. 19, 2015

(87) PCT Pub. No.: WO2014/047917
PCT Pub. Date: Apr. 3, 2014

(65) Prior Publication Data
US 2015/0287526 A1 Oct. 8, 2015

(51) Int. Cl.
*H01F 21/02* (2006.01)
*H01F 21/12* (2006.01)
(Continued)

(52) U.S. Cl.
CPC ..... *H01F 29/04* (2013.01); *H01F 27/28* (2013.01); *H01F 27/38* (2013.01); *H01F 29/02* (2013.01); *H01F 30/02* (2013.01); *H01F 38/08* (2013.01)

(58) Field of Classification Search
CPC ..... H01F 30/02; H01F 38/08
See application file for complete search history.

(56) References Cited

U.S. PATENT DOCUMENTS 2,297,672 A * 9/1942 Stevens ..... G05F 3/06 323/307
2,313,950 A * 3/1943 Langguth ..... H02M 5/08 307/105

(Continued)

FOREIGN PATENT DOCUMENTS

CN 10256878 A 7/2012
CN 202434320 U 9/2012

(Continued)

OTHER PUBLICATIONS

International Search Report, issued in PCT/CN2012/082419, dated Jul. 11, 2013.

(Continued)

*Primary Examiner* — Mangtin Lian
*Assistant Examiner* — Ronald Hinson
(74) *Attorney, Agent, or Firm* — Birch, Stewart, Kolasch & Birch, LLP

(57) ABSTRACT

A single-phase electric furnace transformer is provided according to the basic principle of the invention, comprising: a single magnetic core, said magnetic core comprising two side columns and at least one main column; a main transformer, comprising a first primary side winding and a first secondary side winding which are disposed on said at least one main column, wherein said first primary side winding consists of a first winding and a second winding which are connected in series with each other; and a voltage regulating autotransformer, which is disposed on one of two side columns of said magnetic core, and which comprises a second primary side winding and a second secondary side winding, wherein said second secondary side winding is an adjustable winding having on-load tap switch, and said adjustable winding is connected in series between the first winding and the second winding of said main transformer. The direct effect on the regulating winding and the regulating switch by the over-voltage of the grid can be avoided in the single-phase electric furnace transformer of the invention, and the voltage between two terminals of the primary winding of the main transformer can be reduced. Furthermore, the winding of the voltage regulating transformer is disposed on the side column of the main transformer in the invention, so that the material and the transformer loss can be reduced, and the installation space of the transformer can be decreased.

11 Claims, 6 Drawing Sheets

(51) Int. Cl.

| | |
|---|---|
| ***H01F 17/06*** | (2006.01) |
| ***H01F 29/04*** | (2006.01) |
| ***H01F 29/02*** | (2006.01) |
| ***H01F 27/38*** | (2006.01) |
| ***H01F 30/02*** | (2006.01) |
| ***H01F 38/08*** | (2006.01) |
| ***H01F 27/28*** | (2006.01) |

(56) References Cited

U.S. PATENT DOCUMENTS 2,404,254 A * 7/1946 Short ..... H01F 38/10
307/33

3,182,248 A * 5/1965 McNamee ..... H01F 29/02
336/145

3,699,385 A * 10/1972 Paget ..... H01F 38/10
315/200 R

FOREIGN PATENT DOCUMENTS

WO WO 97/29494 A1 8/1997
WO WO 00/48299 A1 8/2000

OTHER PUBLICATIONS

Written Opinion of the International Searching Authority, issued in PCT/CN2012/082419, dated Jul. 11, 2013.

* cited by examiner

SINGLE-PHASE ELECTRIC FURNACE TRANSFORMER

TECHNICAL FIELD

The invention relates to a voltage regulating technology of an electric furnace transformer, particularly, to a single-phase electric furnace transformer having a novel structure.

BACKGROUND ART

In the metallurgy, chemical, and mechanical industries, it is required to use electric furnaces. Electric furnace transformer is a transformer used for supplying power to an electric furnace in these industries, and it is used for reducing a higher grid voltage to an operation voltage that the electric furnace requires. Because the secondary output voltage of the electric furnace transformer is rather low (from tens of volts to hundreds of volts), the secondary output current is normally large, it can be up to tens of thousands of amperes or even hundreds of thousands of amperes. Another feature of the electric furnace transformer is that the regulating range of the secondary voltage is large, and sometimes, it is required that the secondary voltage can be regulated from the maximum value to 25%~50% of the maximum value. So the essential difference exists between the electric furnace transformer and the power transformer.

For the voltage regulation of the power transformer, the fluctuation of the grid voltage can be adapted by regulating the number of the turns of the primary winding so that the secondary voltage can be maintained constant. The flux of the transformer core is unchanged when regulating the voltage. Such voltage regulation method is called constant flux voltage regulation.

For the voltage regulation of the electric furnace transformer, the secondary voltage is changed under the condition that the primary voltage is unchanged. Because the secondary voltage is low and the number of turns of the winding is small, the voltage regulation tap cannot be disposed at the secondary side to perform the constant flux voltage regulation. In order to regulate the secondary voltage of the electric furnace transformer, there are normally three types of voltage regulation methods based on the practical conditions: direct voltage regulation through varying flux; voltage regulation through transformers connected in series; and voltage regulation through autotransformer. The direct voltage regulation through varying flux is used in the condition that the level difference is not required for the voltage regulation and the regulation range is small. The voltage regulation through transformers connected in series and the voltage regulation through autotransformer are used for a large voltage regulation range or a voltage regulation with level difference.

For example, according to an example, the input voltage at the primary side of a large-capacity (65 MVA) single-phase calcium carbide furnace transformer is 110 kV, it is required that the impedance value of the transformer is small, and it is also required that the impedance for the maximum output voltage tap is less than 3.5%, the maximum output current at the low voltage side is 155 kA, and the output voltage at the low voltage side is 500~1000 V. Because of the impedance and the limitations of the transportation, the autotransformer is required in this example, and the principle of the conventional design is shown as FIG. 1*a*, and the structural arrangement is shown as FIG. 1*b*. As shown in the figures, a single-phase transformer group 100 consists of a secondary autotransformer 101 having regulating winding and a main transformer 102 having fixed transformer ratio. The autotransformer 101 comprises a voltage regulating autotransformer winding 105, and the main transformer 102 comprises a main transformer winding 106. Two individual magnetic cores of the transformer 101 and the transformer 102 form the magnetic circuit portion (voltage regulating autotransformer core 103 and main transformer core 104). In order to reduce the impedance and the transportation height, the main transformer has two winding columns, connecting in series at the primary side, and connecting in parallel at the secondary side. The impulse voltage of the electric grid of 110 kV at the primary side effects directly at the on-load switch and regulating winding to produce large oscillating voltage, the voltage between two terminals at the primary side of the main transformer and between terminals to earth may largely increase.

SUMMARY OF THE INVENTION

A single-phase electric furnace transformer is provided according to the basic principle of the invention, comprising: a single magnetic core, said magnetic core comprises two side (or return) columns and at least one main column; a main transformer, comprising a first primary side winding and a first secondary side winding which are disposed on said at least one main column, wherein said first primary side winding consists of a first winding and a second winding which are connected in series with each other; and a voltage regulating autotransformer, which is disposed on one of two side columns of said magnetic core and comprises a second primary side winding and a second secondary side winding, wherein said second secondary side winding is an adjustable winding having on-load tap switch, and said adjustable winding is connected in series between the first winding and the second winding of said main transformer.

Furthermore, according to an embodiment of the invention, the first secondary side winding of said main transformer consists of two windings which are disposed with respect to the first winding and the second winding of said first primary side winding, respectively.

Furthermore, according to another embodiment of the invention, the first secondary side winding of said main transformer is a single winding which is disposed with respect to the first winding and the second winding of said first primary side winding simultaneously.

In the above two embodiments of the single-phase electric furnace transformer, said second secondary side winding further comprises: a third winding and a fourth winding which are connected in series with each other, wherein said third winding and said fourth winding are adjustable windings having on-load tap switches. In the above single-phase electric furnace transformer, the node between said third winding and said fourth winding is connected to said second primary side winding.

In the above two embodiments of the single-phase electric furnace transformer, said second secondary side winding is a single adjustable winding having on-load tap switch.

In the above single-phase electric furnace transformer, the number of the main column is two, and said first primary side winding and said first secondary side winding are disposed on a respective one of these two main columns.

In the above single-phase electric furnace transformer, the number of the main column is one, and said first primary side winding and said first secondary side winding are disposed collectively on said one main column.

In the above single-phase electric furnace transformer, the primary side winding of said main transformer and the primary side winding of said voltage regulating autotransformer are connected in parallel with each other to the grid.

The direct effect on the regulating winding and the regulating switch by the over-voltage of the grid can be avoided in the single-phase electric furnace transformer of the invention, and the voltage between two terminals of the primary winding of the main transformer can be reduced. Furthermore, the winding of the regulating transformer is disposed on the side column of the main transformer in the invention, the material for manufacturing the transformer can be saved, the transformer loss can be reduced, and the installation space of the transformer can be decreased. Thus, by implementing the technical scheme of the invention, not only the material cost can be reduced, but also the transformer loss can be reduced and further the running cost of the transformer can be reduced, the occupation space of the transformer can be saved, the oil used by the transformer can also be decreased, and the environment pollution can further be reduced, it is benefit to both economy and environmental protection.

It should be understood that the above general description and the following detail description of the invention are examples and illustrations, and it is intended that a further explanation of the invention as described by the Claims will be further provided.

BRIEF DESCRIPTION OF THE DRAWINGS

Drawings, which are collected and form a portion of the application, are included, in order to provide further understanding of the invention, the embodiments of the invention are illustrated in the drawings, and the drawings together with the description has the function of explaining the principle of the invention. In the drawings.

DETAILED DESCRIPTION OF EXAMPLE EMBODIMENTS

Figure 1A:
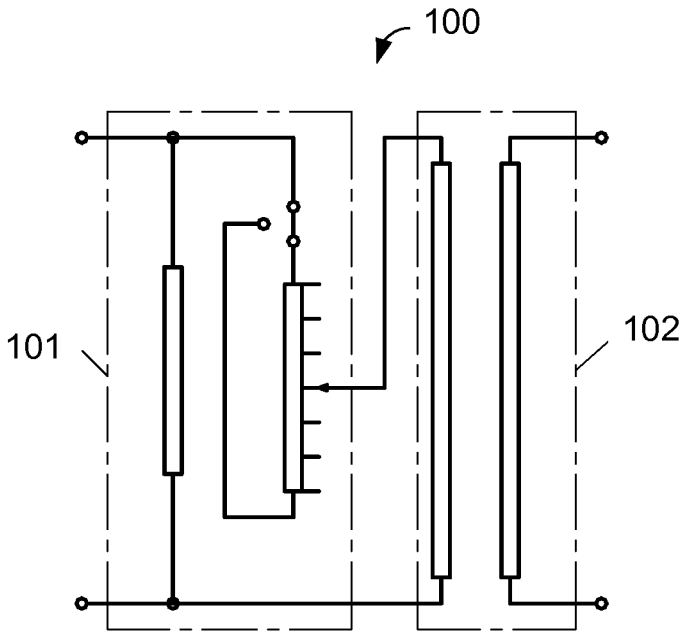
FIG. 1*a* illustrates a circuit diagram of a design scheme of a single-phase electric furnace transformer of the prior art.
Figure 1B:
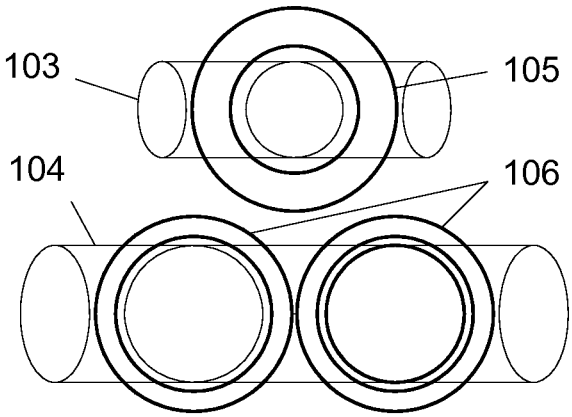
FIG. 1*b* illustrates a structural arrangement of the single-phase electric furnace transformer shown in FIG. 1*a*.

The embodiments of the invention will now be described in detail by referring to the drawings.

The basic principle of the invention will now be discussed in detail by referring firstly to FIG. 2*a*~FIG. 9 as follows. The single-phase electric furnace transformer 200 of the invention comprises mainly: a single magnetic core 201, a main transformer 202, and a voltage regulating autotransformer 203.

Figure 2A:
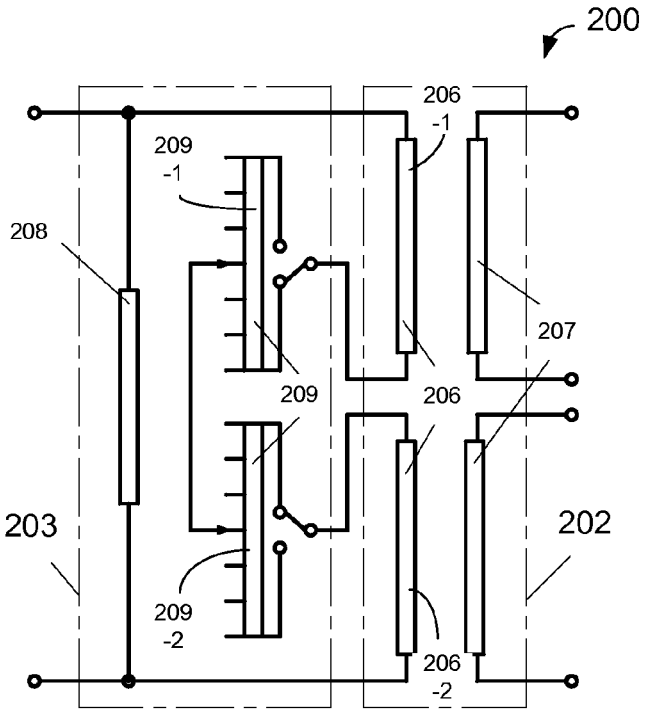
FIG. 2*a* illustrates a circuit diagram of the first embodiment of the invention.
Figure 2B:
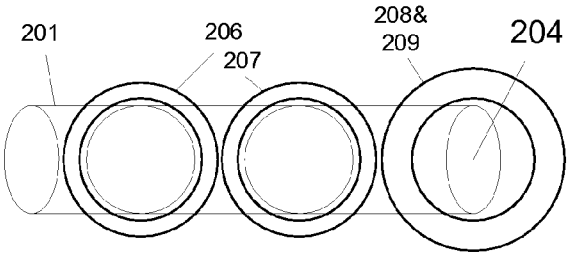
FIG. 2*b* illustrates a structural arrangement of the embodiment shown in FIG. 2*a*.
Figure 2C:
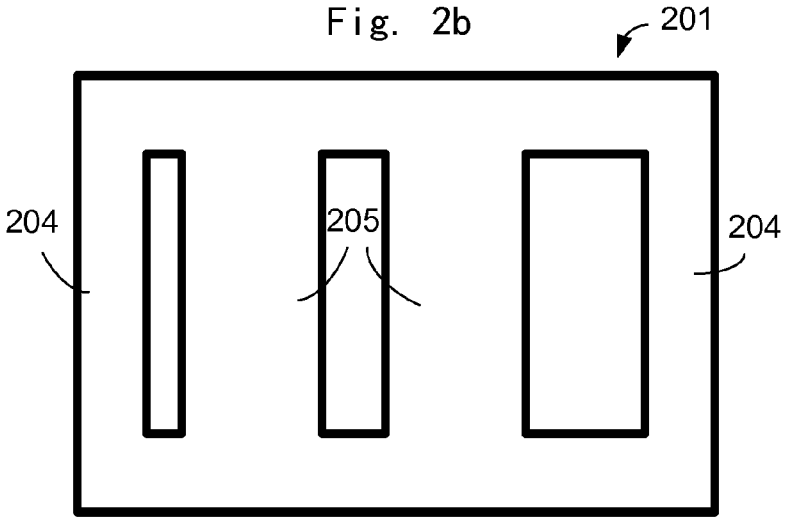
FIG. 2*c* illustrates in detail a magnetic core structure in the embodiment shown in FIG. 2*a*.

As shown in FIG. 2*c*, the single magnetic core 201 comprises two side columns 204 and at least one main column 205 (in the embodiment as shown in FIG. 2*c*, there are two main columns; however, the embodiments only including one main column will be further discussed subsequently). For example, the magnetic core 201 may be an iron core. Said two side columns 204 are disposed at two sides of said main column 205.

Returning to FIG. 2*a*, the main transformer 202 comprises a first primary side winding 206 and a first secondary side winding 207 which are disposed on said at least one main column 205, wherein said first primary side winding 206 consists of a first winding 206-1 and a second winding 206-2 which are connected in series with each other.

The voltage regulating autotransformer 203 can be disposed on one of the two side columns 204 of said magnetic core 201, and comprises a second primary side winding 208 and a second secondary side winding 209. The iron core of the regulating transformer of the prior art can be eliminated by disposing the voltage regulating autotransformer 203 on one of the side columns 204 of the main transformer 202.

Furthermore, the second secondary side winding 209 is an adjustable winding having on-load tap switch, and the adjustable winding can be connected in series between the first winding 206-1 and second winding 206-2 of said main transformer 202, thereby the adjustable input voltage can be obtained at two primary side of the main transformer 202 to realize the adjusting of the low voltage output voltage. It can be seen from the connection diagram, in the voltage regulating process, the voltage between two terminals of the primary side of the main transformer is always the same as the grid voltage. The on-load tap switch is a kind of switch which can provide constant voltage to the transformer when the load is changing, the basic principle of that is to realize the switching among the taps of the transformer winding under the condition that the load current is ensured not to be interrupted, thereby the number of the turns of the winding, that is, the voltage ratio of the transformer, can be changed, and the object of the voltage regulating can be realized finally.

The primary side winding 206 of the main transformer 202 and the primary side winding 208 of the voltage regulating autotransformer 203 are connected in parallel with each other and connected to the grid.

The direct effect on the regulating winding and regulating switch by the over-voltage of the grid can be stopped by changing the structure of the single-phase electric furnace transformer of the invention, thereby the voltage between two terminals of the primary winding of the main transformer can be decreased. Furthermore, the material loss and the installation space can be decreased by disposing the regulating transformer on the side column of the main transformer.

In the first preferred embodiment as shown in FIG. 2*a*~FIG. 2*c*, the main transformer 202 comprises two iron core column, the primary sides of two columns are connected in series, and the secondary sides thereof are connected in parallel. Furthermore, as shown in FIG. 2*a*, the first secondary side winding 207 of the main transformer 202 are formed by two windings which are disposed with respect to the first winding 206-1 and the second winding 206-2 of the first primary side winding 206, respectively.

Furthermore, in the preferred embodiment as shown in FIG. 2*a*~FIG. 2*c*, in the single-phase electric furnace transformer 200 of said embodiment, the above second secondary side winding 209 further comprises: a third winding 209-1 and a fourth winding 209-2 which are connected in series with each other, and are connected in series with the first winding 206-1 and the second winding 206-2 of the first primary side winding 206, respectively, wherein the third winding 209-1 and the fourth winding 209-2 are adjustable windings having on-load tap switches.

It should be also noticed that in the single-phase electric furnace transformer 200 of the first preferred embodiment as shown in FIG. 2*b*, the number of the main columns 205 is two, and said first primary side winding 206 and said first secondary side winding 207 are disposed on a respective one of these two main columns 205.

Figure 3:
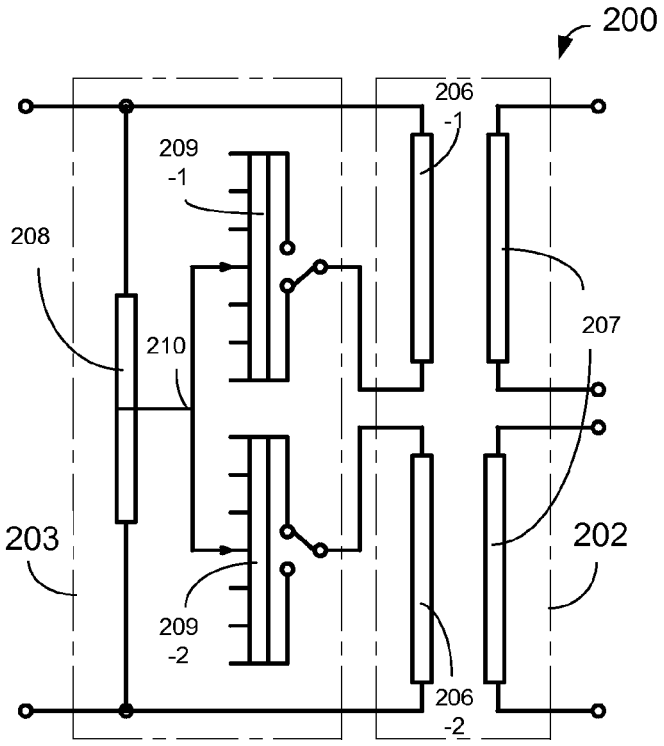
FIG. 3 illustrates a circuit diagram of the second embodiment of the invention.

FIG. 3 illustrates a circuit diagram of the second preferred embodiment of the invention. FIG. 3 is substantially the same as FIG. 2*a*, wherein like reference sign indicates the same components, so that the description of the same components can refer to the above description for FIG. 2*a*, and it will not be repeated herein. By comparing with FIG. 2*a*, the main difference of the second preferred embodiment in FIG. 3 is: the node 210 between the third winding 209-1 and the fourth winding 209-2 is connected to the above second primary side winding 208.

Figure 4:
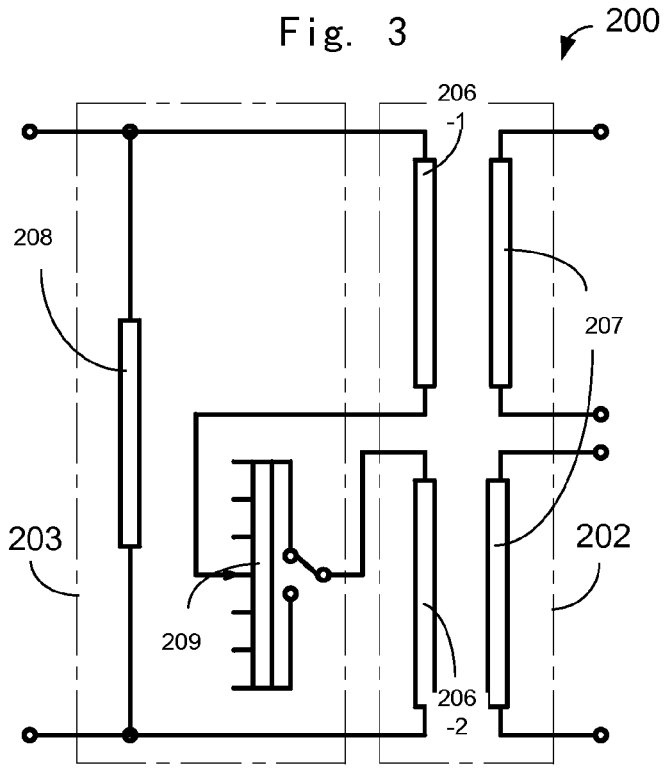
FIG. 4 illustrates a circuit diagram of the third embodiment of the invention.

FIG. 4 illustrates a circuit diagram of the third preferred embodiment of the invention. FIG. 4 is substantially the same as FIG. 2*a*, wherein like reference sign indicates the same components, so that the description of the same components can refer to the above description for FIG. 2*a*, and it will not be repeated herein. By comparing with FIG. 2*a*, the main difference of the third preferred embodiment in FIG. 4 is: the second secondary side winding 209 is a single adjustable winding having on-load tap switch. In this way, the manufacture cost can be further reduced through saving one on-load tap switch. Dual regulating winding is used in FIG. 2*a*, FIG. 3. When the level capacity or level voltage of the voltage regulation is larger than the allowable value of the regulating switch, the technical scheme of the dual regulating winding is preferred, for example, the embodiments shown in FIG. 2*a*, FIG. 3; otherwise, the technical scheme of the single regulating winding is preferred, for example, the embodiment shown in FIG. 4, in order to simplify the structure and reduce the cost.

Figure 5:
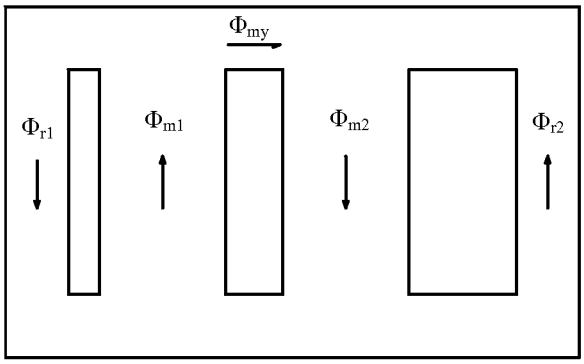
FIG. 5 illustrates the flux of the magnetic core in the first to the third embodiments of the invention.

FIG. 5 illustrates the flux of the magnetic core in the first to the third embodiments of the invention. Referring to FIG. 2*c*, the flux $\Phi_{r1}$ and the flux $\Phi_{r2}$ are the fluxes of the side columns 204 at the left and right sides, respectively. The flux $\Phi_{m1}$ and the flux $\Phi_{m2}$ are the fluxes of both left and right main columns 205. Furthermore, it also comprises the middle iron yoke flux $\Phi_{my}$.

The relationship among the above fluxes can be listed as follows:

$$\Phi_{m1}=\Phi_{my}+\Phi_{r1};$$

$$\Phi_{m2}=\Phi_{my}+\Phi_{r2};$$

$$\Phi_{m1}=\Phi_{m2}=\Phi_{m};$$

then, $$\Phi_{r1}=\Phi_{r2}=\Phi_{r}.$$

wherein $\Phi_{my}$ can be changed between $\Phi_{m\ max}-\Phi_r$ and $\Phi_{m\ min}-\Phi_r$, when $\Phi_{m\ min}=0$, $\Phi_{my}$ may be changed between $-\Phi_{m\ max}$ to $+\Phi_{m\ max}$, therefore, the above embodiments can be used in the regulating range of 0%~100%.

Figure 6:
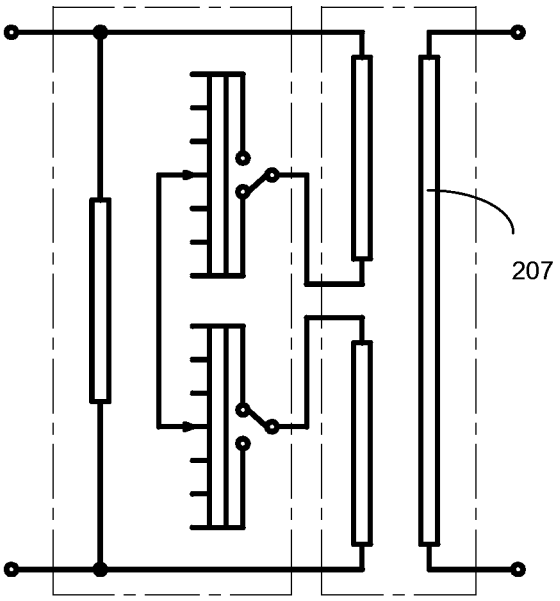
FIG. 6~FIG. 8 illustrate the circuit diagrams of the fourth, the fifth and the sixth embodiments of the invention.
Figure 7:
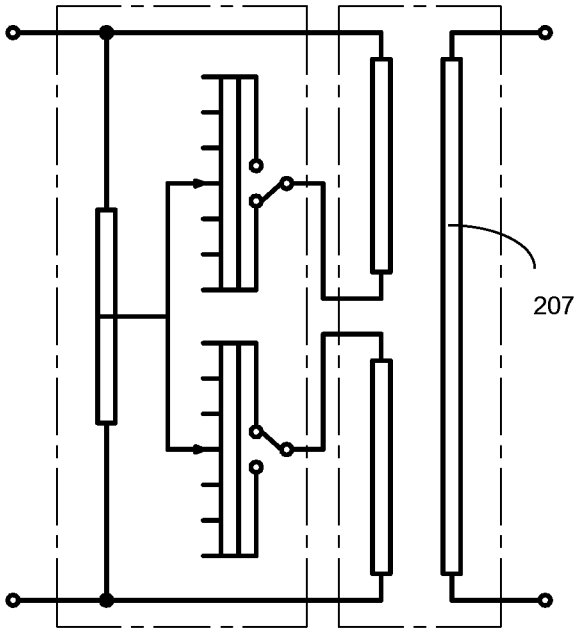
Figure 8:
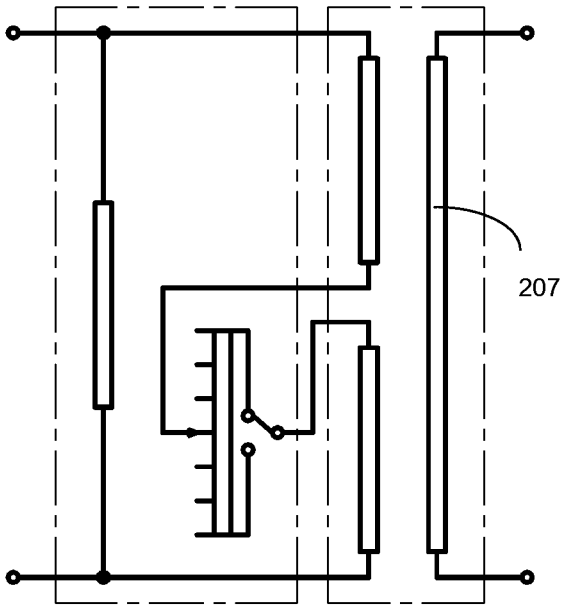

FIG. 6~FIG. 8 illustrate the circuit diagrams of the fourth, the fifth and the sixth preferred embodiments of the invention. Particularly, the embodiment shown in FIG. 6 is similar as that shown in FIG. 2*a*, the embodiment shown in FIG. 7 is similar as that shown in FIG. 3, and the embodiment shown in FIG. 8 is similar as that shown in FIG. 4. In the shown Figs, the similar components are not numbered repeatedly, therefore the content and the reference sign of these similar components can refer to the corresponding FIG. 2*a*, FIG. 3 or FIG. 4, it will not be repeated herein. By comparing with FIG. 2*a*, FIG. 3 and FIG. 4, the respective main difference among the fourth, the fifth, and the sixth preferred embodiments shown in FIG. 6~FIG. 8 is: the first secondary side winding 207 of the main transformer 202 is a single winding which is disposed with respect to the first winding 206-1 and the second winding 206-2 of said first primary side winding 206 simultaneously. Dual main iron core column is used in the embodiments shown in FIG. 2*a*, FIG. 3, FIG. 4. Relatively, single main iron core column is used in the embodiments shown in FIG. 6, FIG. 7, FIG. 8. When the impedance value required by the user is low, the impedance requirement can be satisfied by the structure using the single main iron core column as shown in FIG. 6, FIG. 7, FIG. 8, and the technical scheme of the single main iron core column is preferred, for example, the embodiments shown in FIG. 6, FIG. 7, FIG. 8.

Figure 9:
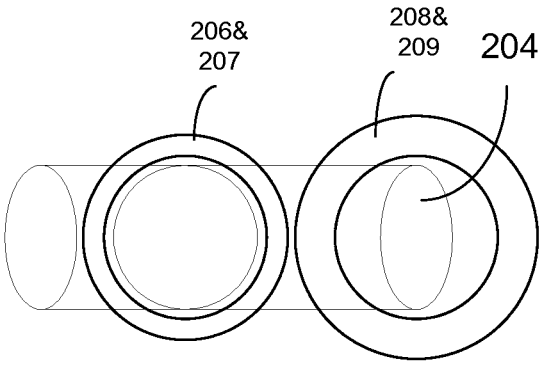
FIG. 9 illustrates another structural arrangement of the single-phase electric furnace transformer according to the invention.

FIG. 9 illustrates another structural arrangement of the single-phase electric furnace transformer according to the invention. The difference with respect to the structural arrangement shown in FIG. 2*b* is: in FIG. 9, the number of the main column can be one based on the different requirement of the impedance, and the first primary side winding 206 and the first secondary side winding 207 are disposed collectively on this single main column According to a detail embodiment of the invention, by comparing a single-phase calcium carbide furnace transformer (having the specification of 65 MVA, 110 kV0.5~1 kV) with a traditional furnace transformer, on the premise that each transformer increases 668 kg of copper, it decreases 14800 kg of silicon steel sheet, decreases 9000 kg of transformer oil, the material cost decreases directly about RMB 300000 Yuan; on the premise that it increases the load loss of 10 kW, the no-load loss can decrease 15.5 kW; at the same time, the overall size of the transformer is: the length increases 300 mm, the width decreases 1500 mm Therefore, for the electric furnace transformer according to the invention, the materials, such as metal, oil, and the like, are saved significantly, the transformer loss is decreased, the transformer efficiency is improved, the size of the transformer is decreased, thereby the area and space occupied by the transformer can be decreased, and the economic and environment protection results can be reached.

It will be apparent to those skilled in the art, various modifications and variants of the above example embodiments of the invention can be made without departing the sprit and scope of the invention. Therefore, it is intended that the modifications and variants of the invention falling within the scope of the Claims and its equivalent technical scheme can be covered by the invention.

What is claimed is:

1. A single-phase electric furnace transformer, comprising:

a single magnetic core, said magnetic core having two side columns and at least one main column;

a main transformer, having a first primary side winding and a first secondary side winding which are disposed on said at least one main column, wherein said first primary side winding consists of a first winding and a second winding which are connected in series with each other; and a voltage regulating autotransformer, disposed on one of the two side columns of said magnetic core, and having a second primary side winding and a second secondary side winding, wherein said second secondary side winding is an adjustable winding having on-load tap switch, and said adjustable winding is connected in series between the first winding and the second winding of said main transformer.

2. The single-phase electric furnace transformer of claim 1, wherein the first secondary side winding of said main transformer consists of two windings which are respectively disposed with respect to the first winding and the second winding of said first primary side winding.

3. The single-phase electric furnace transformer of claim 1, wherein the first secondary side winding of said main transformer is a single winding which is disposed with respect to both the first winding and the second winding of said first primary side winding.

4. The single-phase electric furnace transformer of claim 2, wherein said second secondary side winding further comprises: a third winding and a fourth winding which are connected in series with each other, wherein said third winding and said fourth winding are adjustable windings having on-load tap switches.

5. The single-phase electric furnace transformer of claim 4, wherein a node between said third winding and said fourth winding is connected to said second primary side winding.

6. The single-phase electric furnace transformer of claim 2, wherein said second secondary side winding is a single adjustable winding having on-load tap switch.

7. The single-phase electric furnace transformer of claim 1, wherein the number of the main column is two, and said first primary side winding and said first secondary side winding are disposed on a respective one of these two main columns.

8. The single-phase electric furnace transformer of claim 1, wherein the number of the main column is one, and said first primary side winding and said first secondary side winding are disposed together on said one main column.

9. The single-phase electric furnace transformer of claim 1, wherein the primary side winding of said main transformer and the primary side winding of said voltage regulating autotransformer are connected in parallel with each other to the grid.

10. The single-phase electric furnace transformer of claim 3, wherein said second secondary side winding further comprises: a third winding and a fourth winding which are connected in series with each other, wherein said third winding and said fourth winding are adjustable windings having on-load tap switches.

11. The single-phase electric furnace transformer of claim 3, wherein said second secondary side winding is a single adjustable winding having on-load tap switch.

* * * * *